US010020142B2

(12) United States Patent
Dumont et al.

(10) Patent No.: US 10,020,142 B2
(45) Date of Patent: Jul. 10, 2018

(54) TRIPPABLE CONTROL SYSTEM FOR A BREAKER POLE AND BREAKER GEAR

(71) Applicant: SOCOMEC, Benfeld (FR)

(72) Inventors: Roger Dumont, Benfeld (FR); Arnaud Marchal, Ebersmunster (FR); Damien Rogosinski, Selestat (FR)

(73) Assignee: SOCOMEC, Benfeld (FR)

( * ) Notice: Subject to any disclaimer, the term of this patent is extended or adjusted under 35 U.S.C. 154(b) by 0 days.

(21) Appl. No.: 15/528,662

(22) PCT Filed: Nov. 19, 2015

(86) PCT No.: PCT/FR2015/053144
§ 371 (c)(1),
(2) Date: May 22, 2017

(87) PCT Pub. No.: WO2016/079444
PCT Pub. Date: May 26, 2016

(65) Prior Publication Data

US 2017/0271106 A1 Sep. 21, 2017

(30) Foreign Application Priority Data

Nov. 21, 2014 (FR) ..... 14 61281

(51) Int. Cl.
*H01H 21/30* (2006.01)
*H01H 71/10* (2006.01)
*H01H 21/36* (2006.01)

(52) U.S. Cl.
CPC ..... *H01H 21/30* (2013.01); *H01H 21/36* (2013.01); *H01H 71/1009* (2013.01); *H01H 2235/01* (2013.01)

(58) Field of Classification Search
CPC .. H01H 71/501; H01H 71/52; H01H 2235/01; H01H 21/30; H01H 21/36;
(Continued)

(56) References Cited

U.S. PATENT DOCUMENTS 4,409,449 A * 10/1983 Takano ..... H01H 3/30 200/400
4,481,492 A 11/1984 Borne et al.
(Continued)

FOREIGN PATENT DOCUMENTS

| | | |
|---|---|---|
| EP | 0299291 A1 | 1/1989 |
| FR | 2326026 A1 | 4/1977 |
| FR | 2517114 A1 | 5/1983 |

OTHER PUBLICATIONS

French Search Report From FR Application No. FR1461281, dated Oct. 12, 2015.

(Continued)

*Primary Examiner* — Edwin A. Leon
(74) *Attorney, Agent, or Firm* — Workman Nydegger

(57) ABSTRACT

A trippable control system for one or more electrical breaker poles includes a first link pivotable about a first pivot point between first and second positions; a second link pivotable about a pivot axis for connecting to one or more breaker poles, whereby movement of the first link causes the second link to pivot about the pivot axis between a position for opening and a position for closing the breaker pole(s); and a trip mechanism suitable for releasing the first pivot point and for exerting a movement force on the first link to move the first link between the second and third positions when the first link pivots about a second pivot point. Movement of the first link between the second and third positions causes the second link to pivot about the pivot axis between the position for closing the breaker pole(s) and the position for opening the breaker gear.

9 Claims, 15 Drawing Sheets

(58) Field of Classification Search
CPC ..... H01H 71/1009; H01H 9/28; H01H 9/282; H01H 2071/565; H01H 71/56; H01H 2009/288
USPC ..... 200/400, 335, 43.14; 335/17
See application file for complete search history.

(56) References Cited

U.S. PATENT DOCUMENTS 5,004,875 A * 4/1991 Moody ..... H01H 3/30 200/400
6,800,822 B2 * 10/2004 Hamada ..... H01H 71/58 200/308
7,459,650 B2 * 12/2008 Weister ..... H01H 71/505 200/400

OTHER PUBLICATIONS

International Search Report From PCT Application No. PCT/FR2015/053144, dated Feb. 23, 2016.

* cited by examiner

TRIPPABLE CONTROL SYSTEM FOR A BREAKER POLE AND BREAKER GEAR

BACKGROUND OF THE INVENTION

The present invention relates to the general field of electrical breaker gear, and more particularly to systems enabling breaking to be actuated in this type of gear.

This type of installation comprises one or more electrical breaker poles such as trippable switch-disconnectors, trippable fused switch-disconnectors, trippable switches, and circuit breakers. The main functions of such poles are the following:

setting up and interrupting electric currents on load, on overload, and on short circuits;

protecting a site and personnel against electrical risks; and guaranteeing user safety (actuation, lockout, and isolation).

Electrical breaker gear is fitted with a control system connected to the electrical breaker poles and from which breaking of circuit breaking is controlled. The control system constitutes the most important safety element of the installation since it is the control system that determines the level of performance and the reliability of the electrical breaker gear and also provides the interface between a user and the electrical power portion of the electrically powered device(s).

The control system enables the user to changeover the breaker pole(s) to go from an open position (power off) to a closed position (power on) and vice versa, by means of a manual control handle or by means of an electrical control.

Independently of this normal operation (i.e. the user opening and closing breaker gear), the control system must be capable of changing over the breaker poles to go from the closed position to the open position without requiring direct intervention from a user, and regardless of the conditions under which the system is used, such as for example while a retaining force is being applied at the same time to the control handle. Such automatic changeover from the closed position to the open position is used mainly for performing safety functions such as an emergency stop, thermal overload, differential fault, short circuit, etc.

The control systems that are presently available are not suitable for ensuring an automatic changeover from the closed position to the open position in reliable manner, in particular because they do not supply sufficient mechanical energy to enable electrical power breaker gear to be actuated, or they do not satisfy certain major safety criteria such as changing over independently of conditions of use or ensuring high speed for the changeover operation.

OBJECT AND SUMMARY OF THE INVENTION

An object of the present invention is to propose a novel design for a control system that makes it possible in priority and reliable manner to ensure that the electrical breaker poles change over between the closed position and the open position.

This object is achieved by a trippable control system for one or more electrical breaker poles, the system comprising:

an accumulator mechanism presenting a control handle movable between a breaker position and a closed position;

a first link pivotable about a first pivot point between a first position and a second position, and vice versa, by actuating the control handle of the accumulator mechanism between the breaker position and the closed position, and vice versa;

a second link pivotable about a pivot axis for connecting to one or more breaker poles, the second link being connected to the first link by a sliding connection so that the movement of the first link between the first position and the second position, or conversely between the second position and the first position, causes the second link to pivot about the pivot axis between a position for opening the breaker pole(s) and a position for closing the breaker pole(s), or conversely between a position for closing the breaker pole(s) and a position for opening the breaker pole(s);

a trip mechanism suitable for releasing the first pivot point of first link and for exerting a movement force on the first link in the vicinity of said first pivot point so as to move the first link between the second position and a third position when said first link pivots about a second pivot point, the movement of the first link between the second position and the third position causing the second link to pivot about the pivot axis between the position for closing the breaker pole(s) and the position for opening the breaker pole(s).

By using two movement reversing links and by moving the pivot point of the first link as a function of the movement that is to be performed, the tripping of the priority changeover to the open position may be implemented with a lever arm that is large, thereby amplifying the force transmitted by the trippable control system to the breaker poles, and to do so without losing energy since the changeover of the first link takes place without any need to overcome the resistance of the accumulator mechanism.

Furthermore, the priority changeover into the open position is freely trippable, i.e. it can be controlled independently of any external mechanical influence, and in particular even if a retaining force is being applied to the control handle of the system. There is therefore no need to provide declutching of the manual control of the system in order to trip the priority changeover to the open position.

In a first aspect of the trippable control system of the invention, the accumulator mechanism is suitable for releasing the second pivot point of the first link when the first pivot point of said first link is released by the second trip mechanism so as to drive pivoting of the first link about a third pivot point corresponding to the sliding connection connecting the second link to said first link when the second link reaches its open position, the pivoting of the first link about the third pivot point causing the control handle to move into an intermediate position between the breaking position and the closed position of said handle.

It is thus possible to place the trippable control system in a position that is said to be "tripped" and "uncoupled", enabling a user to see, merely by visually inspecting the position of the control handle, that priority opening of the breaker poles has been tripped.

In an embodiment of the trippable control systems, the accumulator mechanism comprises an inner carriage connected to the control handle and an outer carriage connected to the first link, the system further comprising a bias spring suitable for moving the inner and outer carriages over a short distance when the accumulator mechanism releases the second pivot point of the first link in such a manner as to drive pivoting of the first link about the third pivot point and movement of the control handle into an intermediate position between the breaking position and the closed position of said handle, thus making it possible to see the tripped position of the system merely by visually inspecting the position of the control handle.

In a second aspect of the trippable control system of the invention, the first accumulator mechanism comprises a first spring suitable, when compressed, for exerting a force on the first link as it pivots about the first pivot point between the first position and the second position of said first link, and vice versa, and in that the trip mechanism comprises a second spring suitable, when compressed, for exerting a force on the first link during its movement between the second position and the third position when said first link pivots about the second pivot point.

By using a spring that is dedicated to each of the two mechanisms, it is ensured that the speed of the changeover between the open and closed positions, and vice versa, is high, which is important for providing safety when breaking an electric circuit.

The first spring and the second spring make it possible to obtain similar torque curves, thus making it possible to have trip speeds that are similar in both mechanisms and thus provide breaking safety under all circumstances.

In a third aspect of the trippable control system of the invention, the system comprises manual control means for releasing the first pivot point of the first link.

In a fourth aspect of the trippable control system of the invention, it comprises electromechanical control means for releasing the first pivot point of the first link.

Regardless of whether they are manual or electromechanical, the control means require very little energy for changing over into the open position.

In a fifth aspect of the trippable control system of the invention, the accumulator mechanism comprises an inner carriage connected to the control handle and an outer carriage connected to the first link, the inner carriage sliding in the outer carriage during the movement of the control handle between the breaking position and the closed position, the first spring being interposed between the inner carriage and the outer carriage, and in that the trippable control system comprises a latch element suitable for locking the inner carriage with the outer carriage after the movement of the first link between the second position and the third position so as to enable the second spring of the trip mechanism to be reset while avoiding compressing the first spring.

It is thus possible to couple together the inner and outer carriages briefly in order to enable the system to be reset. Only the second spring of the second trip mechanism is reset. The resetting force that needs to be applied is thus reduced as a result of the structure of the trippable control system of the invention.

The present invention also provides electrical breaker gear comprising one or more electrical breaker poles fitted with a movable contactor, characterized in that said gear further comprises a trippable control system of the invention, a breaker shaft connecting each movable contactor of the breaker pole(s) to the pivot axis of the second link.

BRIEF DESCRIPTION OF THE DRAWINGS

Other characteristics and advantages of the invention appear from the following description of particular embodiments of the invention, given as non-limiting examples, and with reference to the accompanying drawings, in which.

DETAILED DESCRIPTION OF AN EMBODIMENT

Figure 1A:
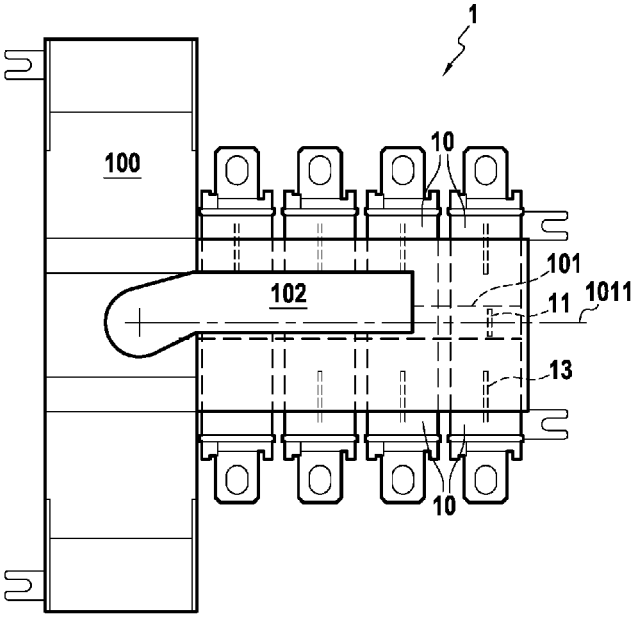
FIG. 1A is a diagrammatic view showing a trippable control system in a breaking position in an embodiment of the invention.
Figure 1B:
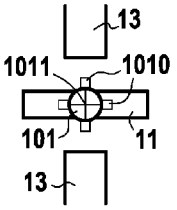
FIG. 1B shows a movable contactor in the breaking position of the FIG. 1A system.

FIG. 1A shows breaker gear 1 in accordance with an embodiment of the invention. In the presently-described embodiment, the gear 1 comprises a trippable control system 100 in accordance with an embodiment, together with a plurality of breaker poles 10. The breaker poles 10 correspond to breaker devices such as interrupters, switches, or fused switch-disconnectors. As shown in FIGS. 1A and 1B, each breaker pole 10 is connected to the trippable control system 100 by a breaker shaft 101 that is secured firstly to a link of the system 100, as described in detail below, and secondly to each movable contactor of the breaker poles that correspond in this example to a set of movable contacts 11, the shaft 101 defining the axis of rotation for the movable contacts 11. When the shaft 101 is caused to turn by the system 100 that serves to move the movable contacts 11 of each breaker pole between an open position (FIG. 1A) in which the movable contacts 11 are placed at a distance from stationary contacts 13 of the breaker gear (FIG. 1B) and a closed position (FIG. 2A) in which the movable contacts 11 are in contact with the stationary contacts 13 of the breaker poles (FIG. 2B), and vice versa. In the presently-described embodiment, the breaker poles 10 are opened and closed, and vice versa, under the control of a control handle 102 that is movable between a first position shown in FIG. 1A corresponding to the breaker poles 10 being in the open position, and a second position shown in FIG. 2A corresponding to the breaker poles 10 being in the closed position.

Figure 4:
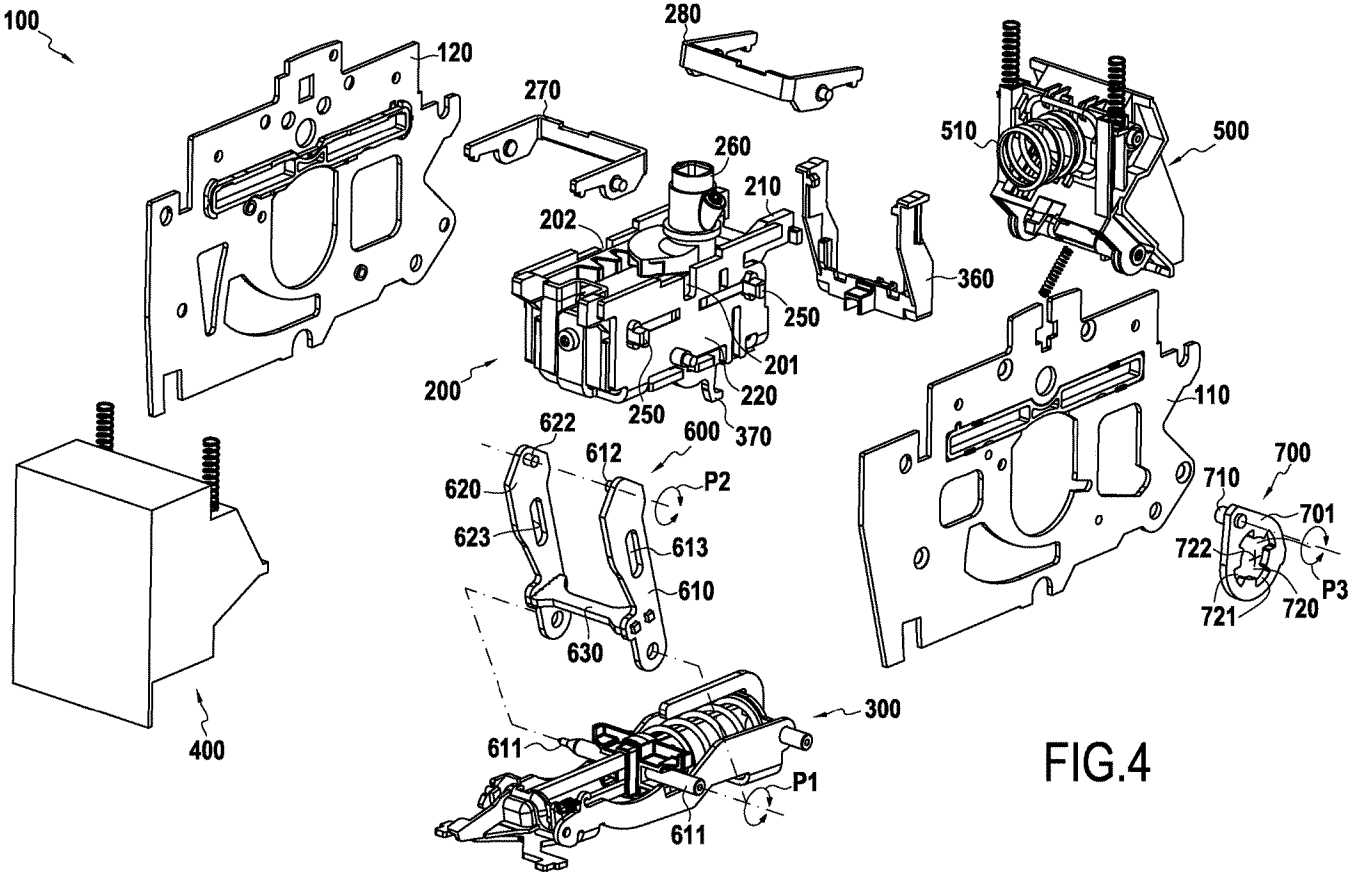
FIG. 4 is a diagrammatic exploded perspective view of the trippable control system of FIGS. 1A to 3A.

FIG. 4 shows the various elements of the trippable control system 100 in an embodiment of the invention. The system 100 comprises:

an accumulator mechanism 200;
a trip mechanism 300;
a trip control module 400;
an auxiliary contact module 500;
a first pivotal link 600; and
a second pivotal link 700.

These elements are assembled together and held by two sheet-metal cheek-plates 110 and 120.

Figure 5:
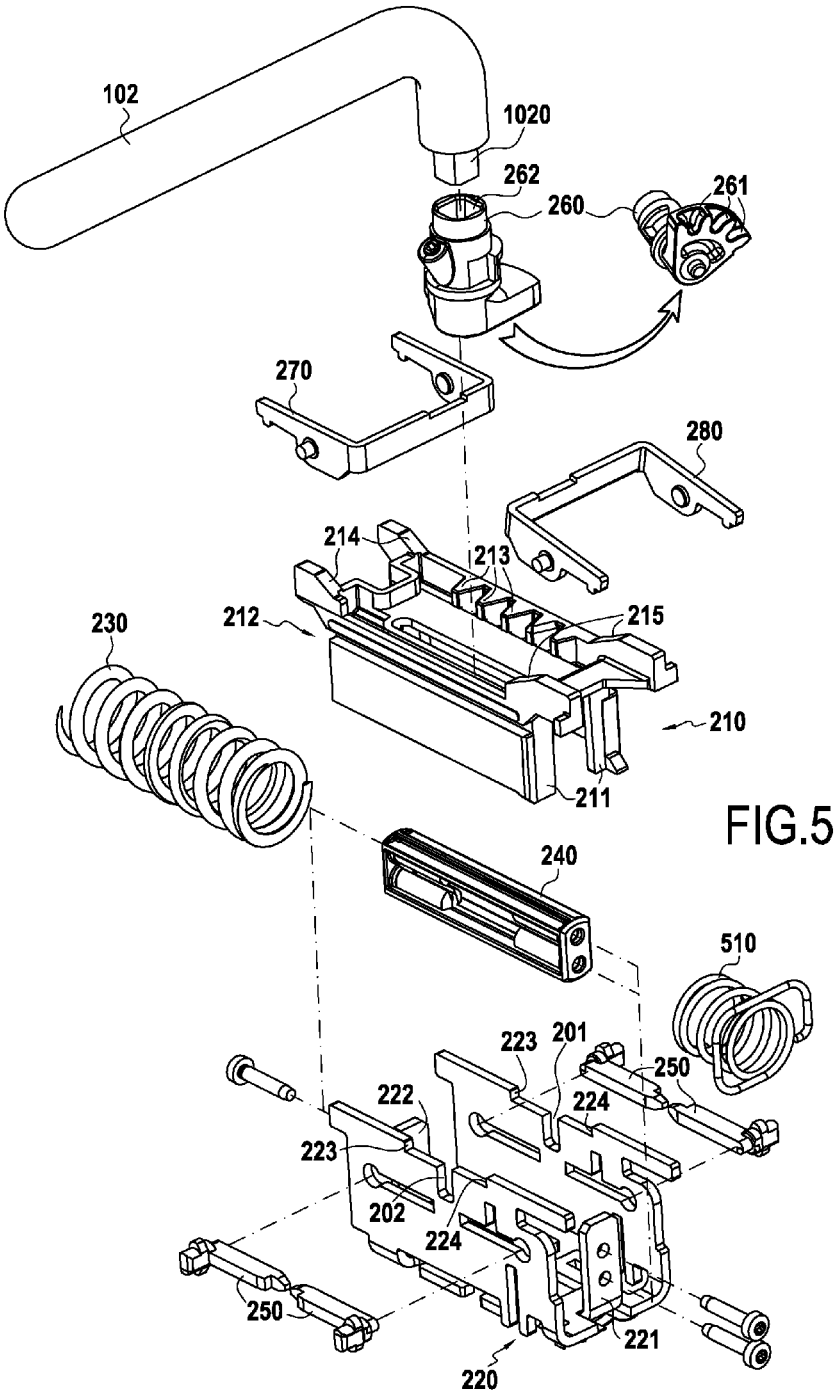
FIG. 5 is a diagrammatic exploded perspective view of the accumulator mechanism shown in FIG. 4.

As shown in FIG. 5, the accumulator mechanism 200 comprises:

an inner carriage 210;
an outer carriage 220;
an accumulator spring 230;
a spring guide 240;
carriage guides 250;
an angle transmission 260;
a first rocker pawl 270; and
a second rocker pawl 280.

Figure 6:
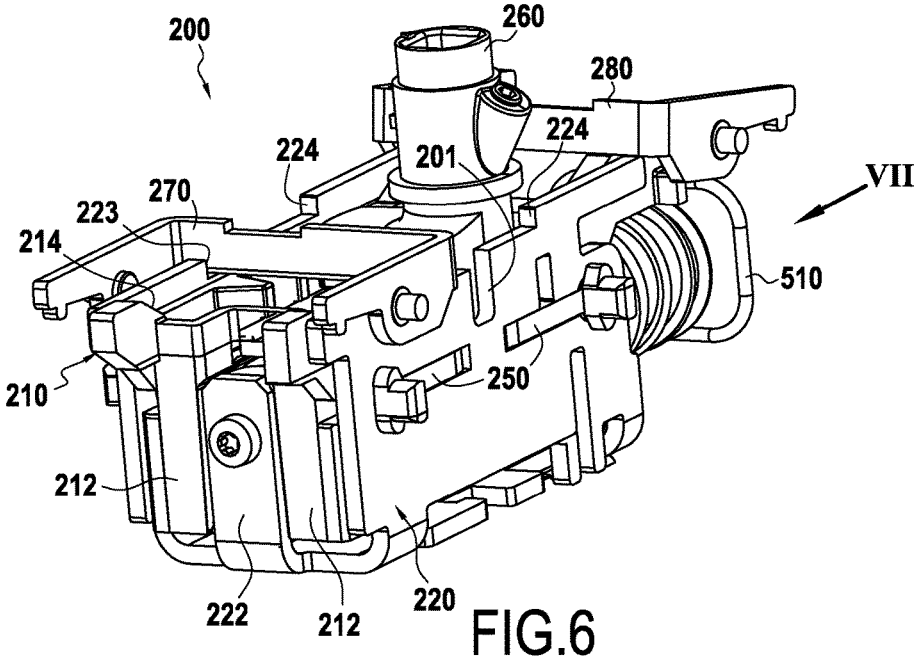
FIGS. 6 and 7 are perspective views of the accumulator mechanism once assembled.
Figure 7:
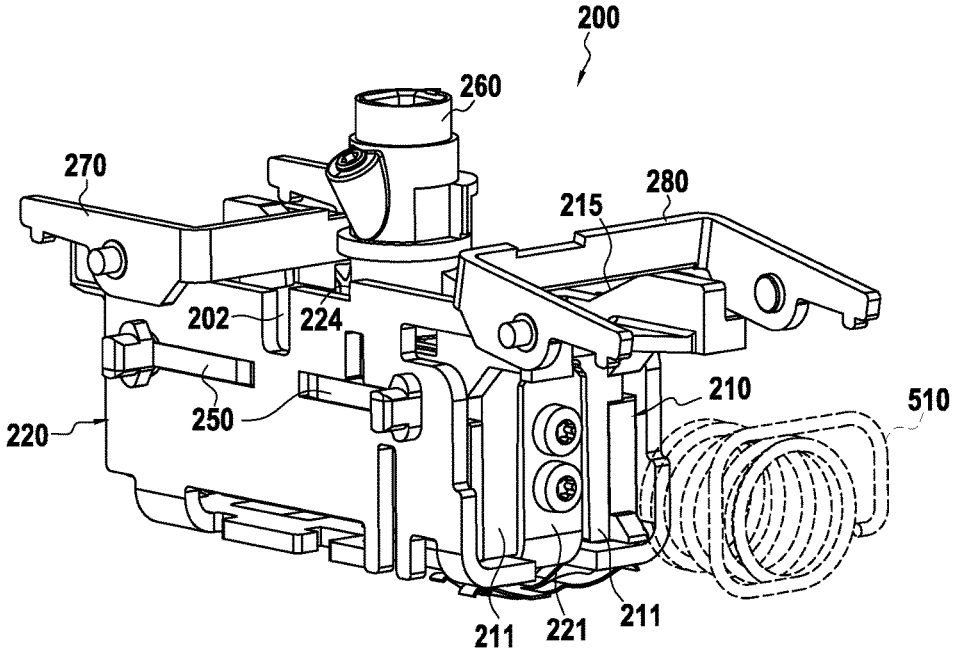
Figure 10:
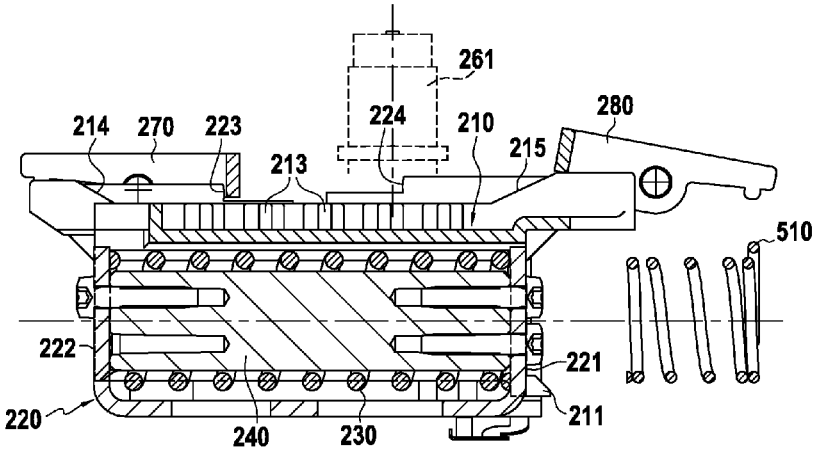
FIG. 10 is a section view of the accumulator mechanism when the trippable control system is in a breaking position.

The inner and outer carriages 210 and 220 are mounted to slide relative to each other, the carriage guides 250 directing relative sliding between the two carriages. While assembling the inner carriage 210 in the outer carriage 220, the accumulator spring 230 is interposed between the two carriages. More precisely, the spring 230 is held on the spring guides 240 that is itself fastened to two fastener tabs 221 and 222 respectively present at the two ends of the outer carriage 220. At rest, the spring 230 extends between the two tabs 221 and 222, as shown in FIG. 10. The inner carriage 210 has two pairs of thrust tabs 211 and 212 each arranged respectively on either side of the tabs 221 and 222 (FIGS. 5, 6, and 7). As explained below, the thrust tabs 211 and 212 are for coming into abutment against one of the ends of the spring 230 in order to compress it during movement of the inner carriage inside the outer carriage during operations of opening and/or closing the breaker gear 10. The inner carriage 210 has rack teeth 213 on its top portion for co-operating with gears 261 of the control shaft 260. The control shaft 260 also has a housing 262 suitable for receiving the shaft 1020 of the handle 102.

Figure 2A:
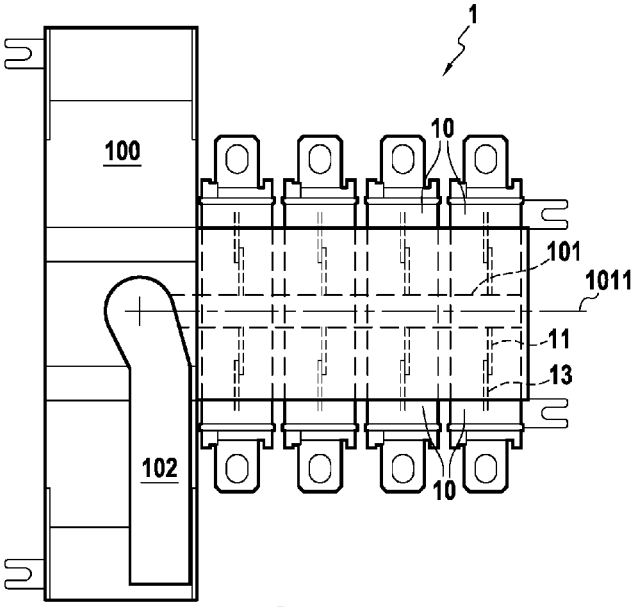
FIG. 2A is a diagrammatic view showing a trippable control system in a closed position in accordance with an embodiment of the invention.
Figure 2B:
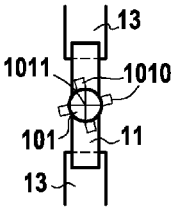
FIG. 2B shows a movable contactor in the closed position of the FIG. 2A system.

As shown in FIG. 4, the first pivotal link 600 comprises an arm 610 suitable for pivoting about a first pivot point P1 formed by a pin 611 that is held by the second trip mechanism 300. The arm 610 also has at its top end a pin 612 that is gripped to said top end and that is for engagement in an opening 201 formed in the outer carriage 220. The pin 612 constitutes a second pivot point P2 about which the arm of the link 600 can pivot when the pin 611 is released by the second trip mechanism, as explained in detail below. In the presently-described embodiment, the link 600 has a second arm 620 connected to the first arm 610 by a spar 630. In symmetrical manner, the second arm is suitable for pivoting firstly about the pivot point P1 when the pin 611 is retained by the second trip mechanism 300, and secondly about the second pivot point P2 when the pin 611 is released by the second trip mechanism, the arm 620 having a pin 622 gripped to its top end for engaging in an opening 202 formed in the outer carriage. The second pivotal link 700 comprises a body 701 having an opening 720 for receiving one end of the shaft 101 for causing the breaker poles 10 to open and close. In order to enable the shaft 101 to be turned, the opening 720 includes crenellations 721 for co-operating with teeth 1010 present on the outside surface of the shaft 101 (FIGS. 1B and 2B). The center 722 of the opening 720 coincides with the center 1011 of the shaft 101. The second link 700 further includes a peg 710 present on the body 701 in a position that is offset from the position of the opening 720. The peg 720 is designed to be engaged in an oblong slot 613 formed in the arm 610 of the link 600 and to slide therein during movements of the link 600 so as to provide a sliding and hinged connection between the links 600 and 700.

Figure 8:
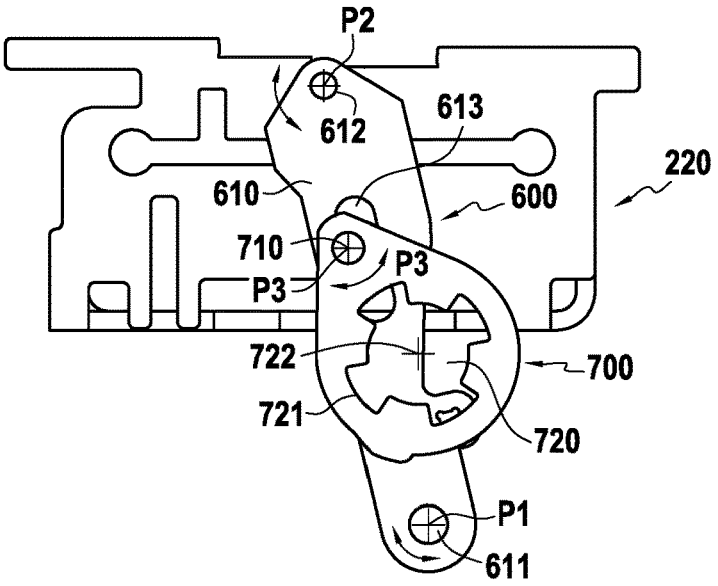
FIG. 8 is a simplified diagrammatic view showing the position of the first and second links when the trippable control system is in a breaking position.
Figure 9:
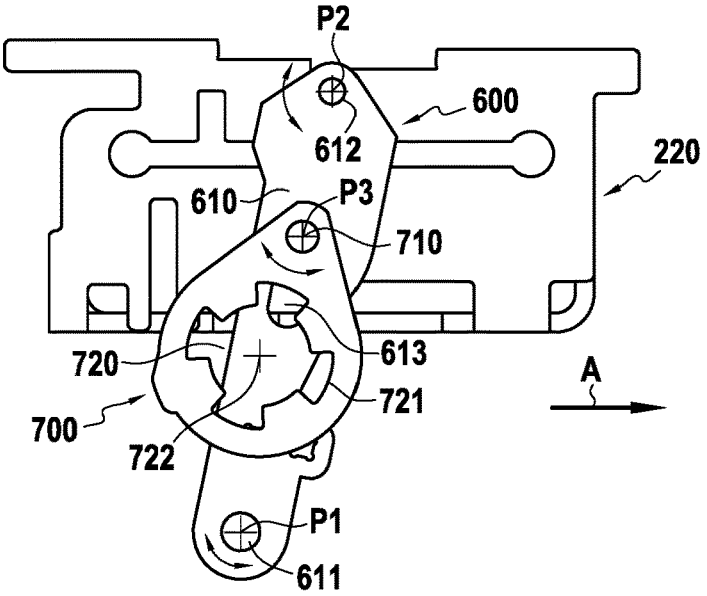
FIG. 9 is a simplified diagrammatic view showing the positions of the first and second links when the trippable control system is actuated towards a closed position.

FIG. 8 shows the links 600 and 700 together with the outer carriage 220 in a position corresponding to the breaker gear being open, as shown in FIGS. 1A and 1B. FIG. 9 shows the outer carriage 220 moved in the direction A, thereby causing the first link 600 to pivot about the first pivot point P1 that in turn has driven pivoting of the second link 700 about the center 722 of the opening 720 by the peg 710 sliding in the oblong slot 613, the center 722 corresponding to the pivot axis of the second link 700. Pivoting of the link 700 causes the shaft 101 (not shown in FIG. 9) to turn through an angle that is sufficient to close the breaker poles, as shown in FIGS. 2A and 2B.

There follows an explanation about how tripping of the movement of the outer carriage between the position for opening the breaker poles and the position for closing the breaker poles, and vice versa, is controlled.

Figure 11:
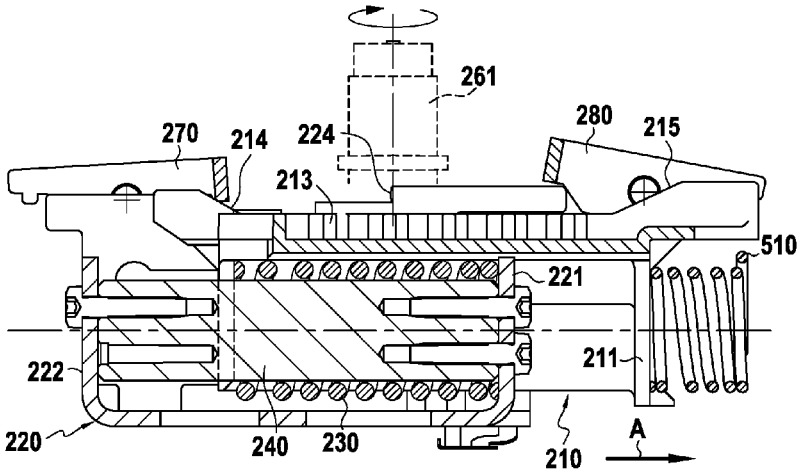
FIG. 11 is a section view of the accumulator mechanism when the control handle of the trippable control system is actuated towards a closed position, with the spring of the accumulator mechanism compressed.
Figure 12:
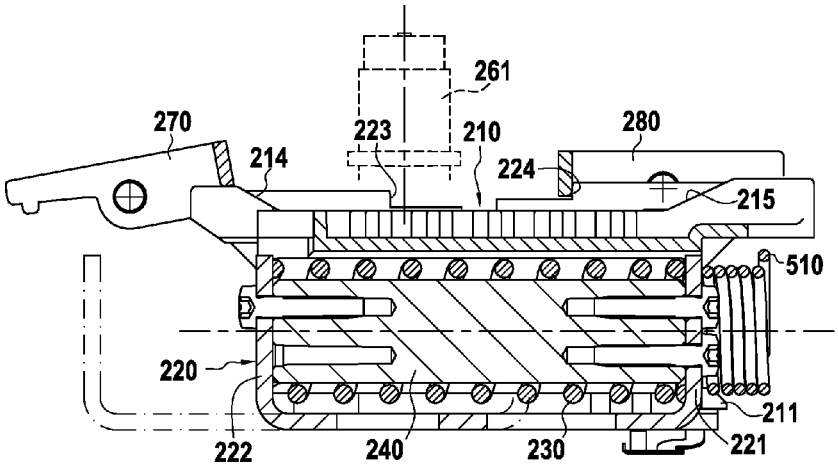
FIG. 12 is a section view of the accumulator mechanism when the trippable control system is in a closed position.

FIGS. 10, 11, and 12 show the relative movements of the inner and outer carriages 210 and 220 for passing from the position for opening the breaker poles to the position for closing the breaker poles by tripping the movement of the outer carriage. FIG. 10 shows the relative position between the inner and outer carriages 210 and 220 corresponding to the positions of the first link 600 and of the second link 700 shown in FIG. 8 (breaker poles in the open position). FIG. 12 shows the relative position between the inner and outer carriages 210 and 220 corresponding to the positions of the first link 600 and of the second link 700 as shown in FIG. 9 (breaker poles in the closed position).

The first rocker pawl 270 serves momentarily to block movement of the outer carriage 220 in the direction A shown in FIG. 11 so as to make it possible, initially, to compress the accumulator spring 230 (FIG. 11), and subsequently to trip the movement of the outer carriage 220 in the direction A under the effect of the action of the spring 230 (FIG. 12). More precisely, as shown in FIG. 10, when the first pawl 270 is in its low position, it bears against rims 223 provided in the top portion of the outer carriage 220, thereby enabling the outer carriage to be held. In its top portion, the inner carriage 210 has two ramps 214 that are designed to lift the first rocker pawl 270 during the movement of the inner carriage 210 in the direction A as shown in FIG. 11 and to disengage the pawl 270 progressively from the rims 223, until movement of the outer carriage is released, as shown in FIG. 12.

Figure 13:
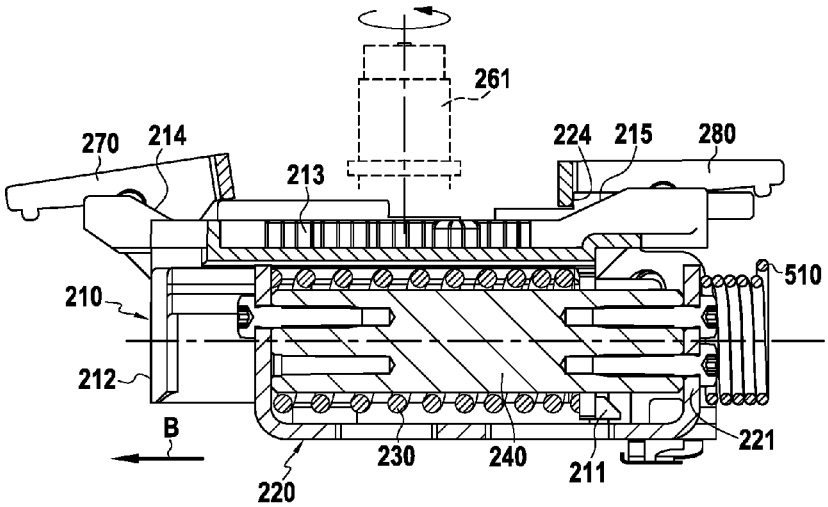
FIG. 13 is a section view of the accumulator mechanism when the control handle of the trippable control system is actuated towards an opening position with the spring of the accumulator mechanism compressed.

In the same manner, FIGS. 12, 13, and 10 show the relative movements of the inner and outer carriages that serve to pass from the position for closing the breaker poles to the position for opening the breaker poles by tripping the movement of the outer carriage, FIG. 10 showing the relative position between the carriages 210 and 220 corresponding to the positions of the links 600 and 700 shown in FIG. 8 (breaker poles in the open position), with FIG. 12 showing the relative position between the carriages 210 and 220 corresponding to the positions of the links 600 and 700 shown in FIG. 9 (breaker poles in the closed position).

The second rocker pawl 280 is designed momentarily to block movement of the outer carriage 220 in the direction B shown in FIG. 13 so as to make it possible initially to compress the accumulator spring 230 (FIG. 13), and subsequently to trip the movement of the outer carriage 220 in the direction B under the effect of the action of the spring 230 (FIG. 10). More precisely, as shown in FIG. 12, when the second pawl 280 is in its low position, it bears against rims 224 provided in the top portion of the outer carriage 220, thereby serving to retain the outer carriage. In its top portion, the inner carriage 210 has two ramps 215 that are designed to lift the first rocker pawl 280 during movement of the inner carriage 210 in the direction B, as shown in FIG. 13 and to disengage the pawl 280 progressively from the rims 224, until the movement of the outer carriage is released, as shown in FIG. 10.

Figure 14A:
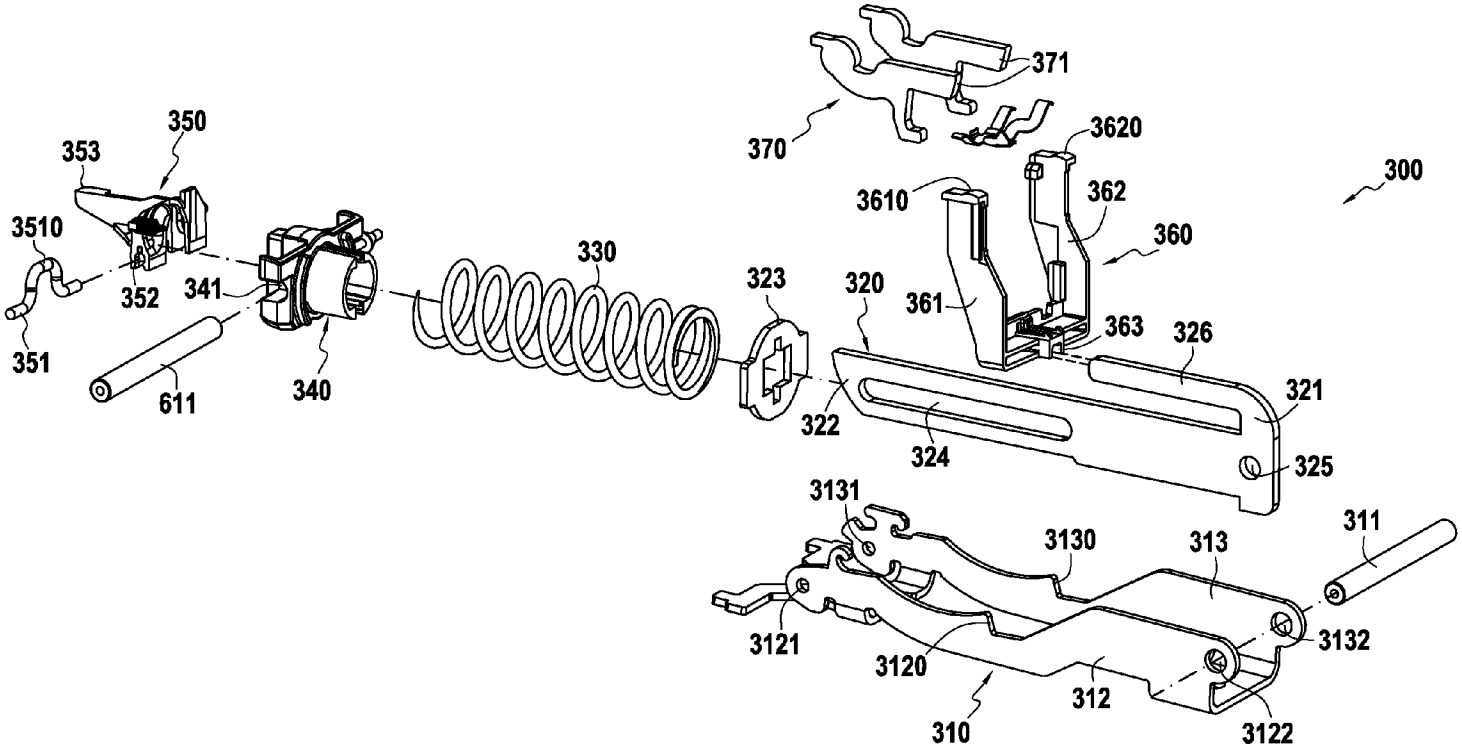
FIG. 14A is a diagrammatic exploded perspective view of the trippable mechanism shown in FIG. 4.
Figure 14B:
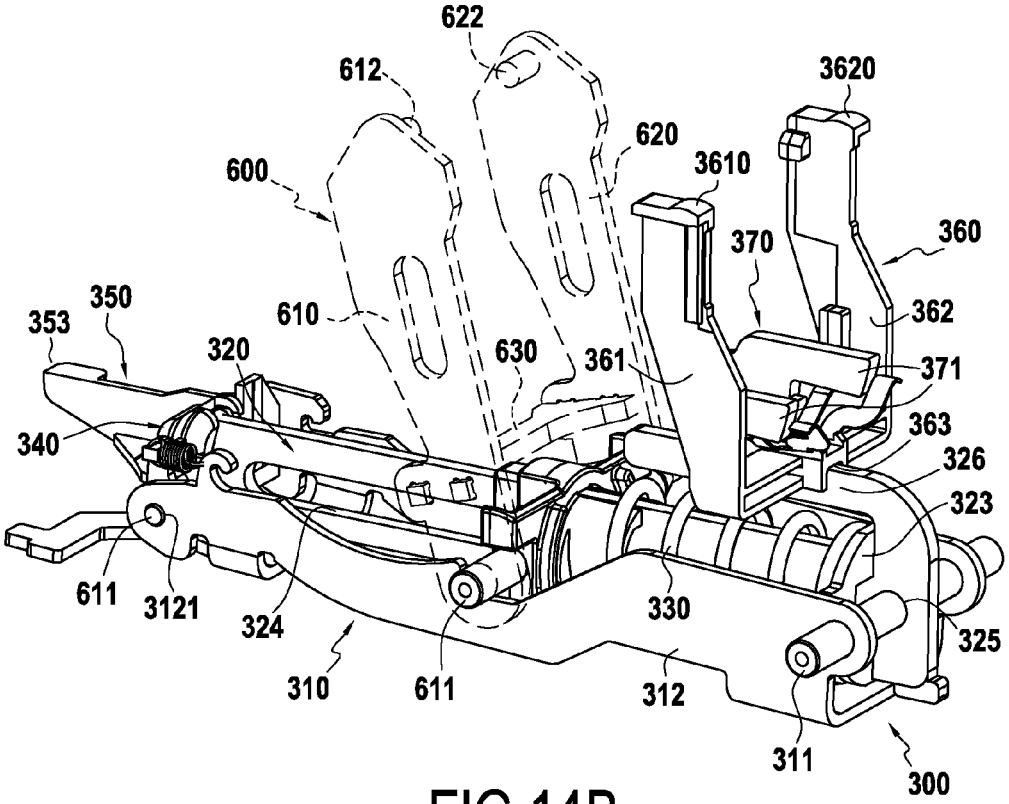
FIG. 14B is a perspective view of the trippable mechanism once assembled.

As shown in FIGS. 14A and 14B, the trip mechanism 300 includes a hook 310 suitable for pivoting about a pin 311 that is held in a stationary position in the trip control system 100. In the presently-described embodiment, the hook 310 has symmetrical first and second arms 312 and 313 that are connected together and that have respective orifices 3122 and 3132 at one of their ends through which the pin 311 passes. The trip mechanism 300 also includes a guide 320 on which a spring 330 is mounted, the spring 330 coming into abutment firstly against a first end 321 of the guide 320 via a washer 323 engaged with the guide 320, and secondly against a slide 340. The guide 320 is pivotally mounted relative to the hook 310, with the guide 320 including an orifice 325 for this purpose through which the pin 311 passes. The slide 340 has a through orifice 341 in which the pin 611 of the link 600 is engaged, the pin 611 also being received in an oblong slot 324 formed in the guide 320 so as to avoid impeding movement of the slide 340 along the guide 320. The trip mechanism 300 also includes a lever 350 that is pivotally attached to the hook 310 by means of a pin 351 and that is inserted both in orifices 3121 and 3131 formed respectively in the arms 312 and 313 of the hook 310, and also in a passage 352 formed in the lever 350. The pin 351 includes a trip catch 3150 in its middle portion that, when locked, serves to hold the hook 310 in its position shown in FIG. 15.

As explained below, the trip mechanism is for holding the link 600 in a first position (FIG. 15) in which the pin 611 is held by rims 3120 and 3130 present respectively on the arms 312 and 313 of the hook 310. In this first position, the link 600 is suitable for pivoting about its first pivot point P1, while the spring 330 is held in compression. The pin 611 of the link 600 is released from the rims 3120 and 3130 when the trip control module 400 exerts a thrust force Fp on the lever 350 so as to unlock the trip catch 3150, thereby enabling the hook 310 to be lowered relative to the pin 611 and enabling its rims 3120 and 3130 to be disengaged.

The spring 330 applies a force against the rims 3120 and 3130. This force gives rise to a counterclockwise torque on the hook 310. The trip catch 3150 produces a reaction torque on the hook 310 opposing that generated by the action of the spring 330 on the rims 3120 and 3130. The hook 310 is thus kept in equilibrium in its FIG. 15 position so long as the catch 3510 is engaged, i.e. locked. The catch 3510 is said to be "stable" in order to minimize the force Fp. As soon as the catch 3510 is unlocked, the reaction torque that it produces disappears, leading to pivoting of the hook 310.

Because of the architecture of the trip mechanism with large lever arms and two catches in cascade enabling force to be increased considerably, the thrust force Fp is very small compared with the force of the spring 330. This characteristic makes it possible to reduce the mechanical power that the trip module 400 needs to supply. In this second position, the link 600 is suitable for pivoting about the pivot point P2 under the effect of the thrust exerted by the spring 330. The trip control module 400 in this example is constituted by a coil actuator (not shown) that serves to exert a thrust force on the lever. Nevertheless, any other type of actuator, whether electromechanical or manual, could be used to exert a thrust force on the lever 350.

There follows a description of the operation consisting in automatically tripping opening of the breaker poles connected to the trippable control system of the invention, with this taking place independently of any control being applied to the system via the control handle, as described above. In other words, the operation of tripping opening of the breaker poles as described herein corresponds to a safety function (e.g. in the event of an emergency stop, thermal overload, a differential fault, a short circuit, etc.) that can be implemented without requiring direct intervention from an operator.

Figure 18:
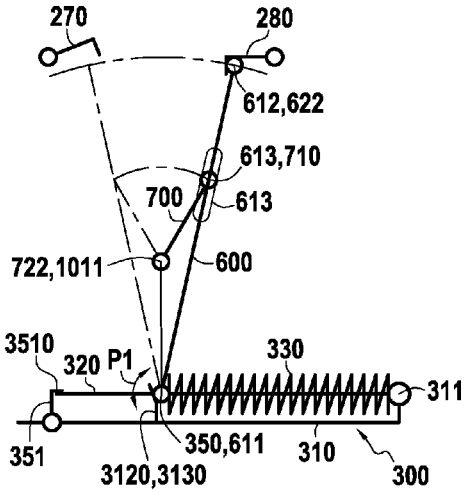
FIGS. 18 to 20 are simplified diagrammatic views showing the positions of the first and second links of the trippable control system when it is respectively in a closed position, a tripped breaking position, and a tripped and uncoupled breaking position.
Figure 19:
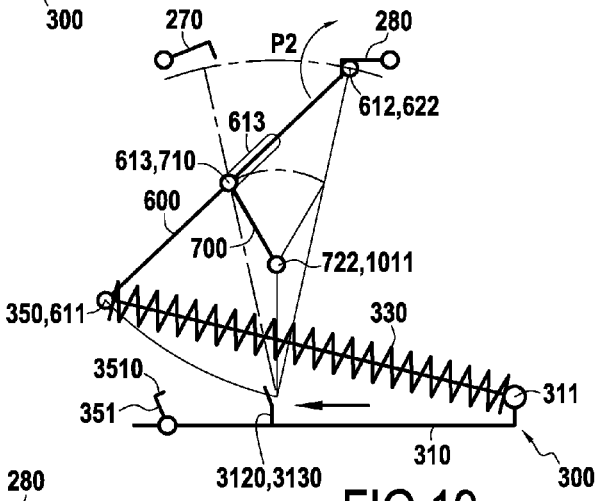

For better understanding, the dynamics of the operation of tripping the trippable control system of the invention for forcing opening of breaker poles are described in particular with reference to FIGS. 18 and 19, which are diagrams showing the relative movements between the first link 600, the second link 700, and the trip mechanism 300.

Figure 15:
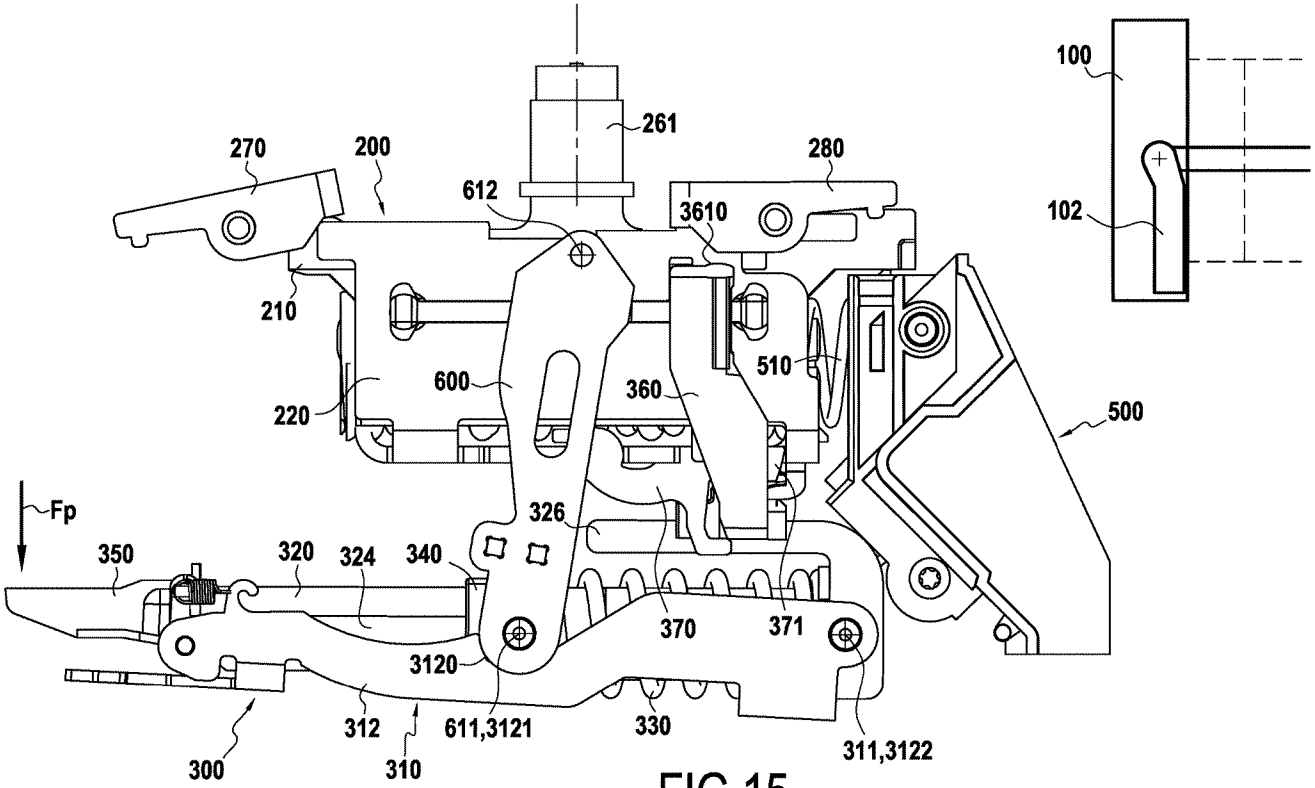
FIG. 15 is a diagrammatic side view showing some of the component elements of the trippable control system of FIGS. 1A to 3A when it is in a closed position.

The tripping operation is implemented when the trippable control system is in the position shown in FIG. 18, which corresponds:

to the position for closing the breaker poles, as shown in FIG. 2B;

to the positions of the links 600 and 700 as shown in FIG. 9;

to the relative position between the inner carriage 210 and the outer carriage 220 as shown in FIG. 12; and to the trip mechanism 300 being in the position as shown in FIG. 15.

Figure 16:
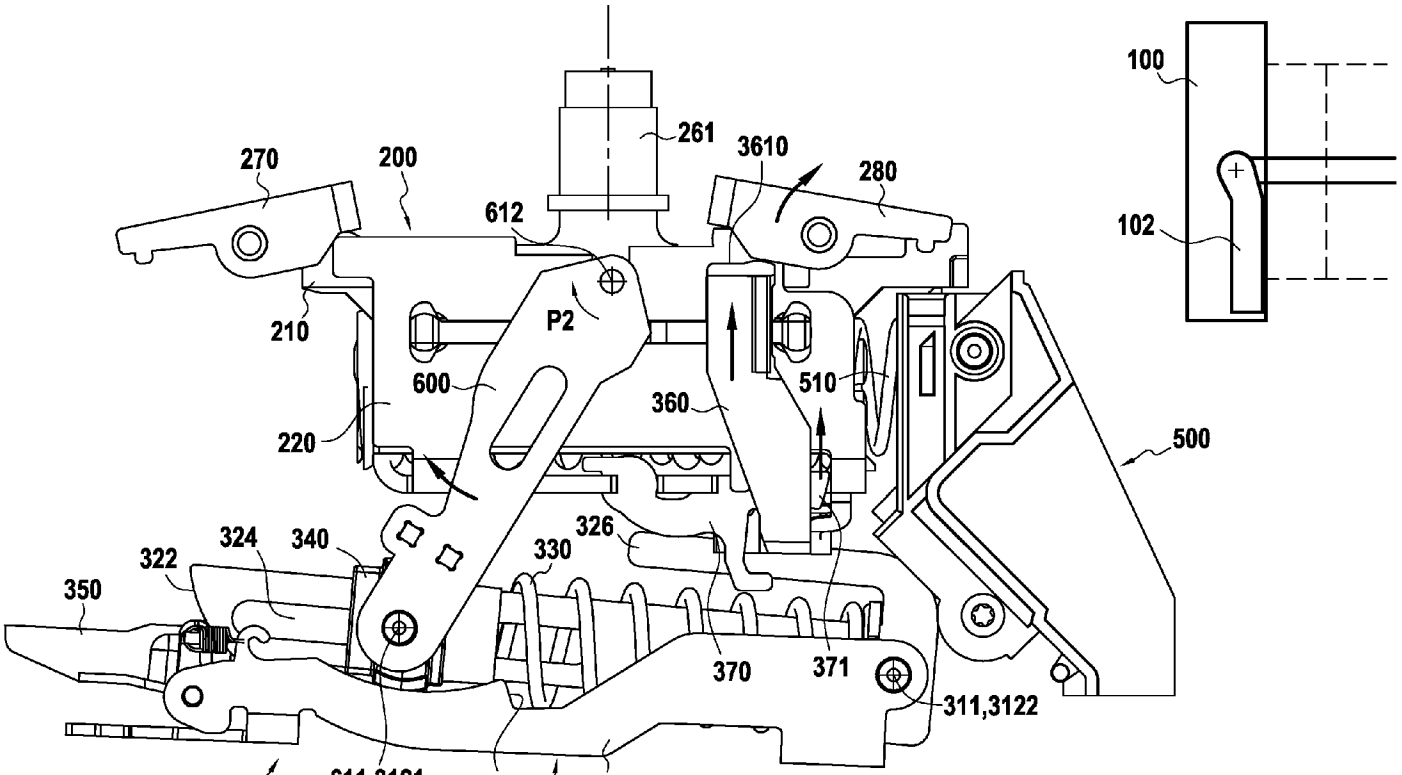
FIG. 16 is a diagrammatic side view showing some of the component elements of the trippable control system of FIGS. 1A to 3A when it is at the beginning of tripping to perform a safety break.

As described above, and as shown in FIG. 15, tripping for forcing opening of the breaker poles is controlled by the trip control module 400 (not shown in FIG. 15) exerting a thrust force Fp on the lever 350 that is secured to the hook 310. The thrust force Fp serves to lower the arms 312 and 313 of the hook 310 of the second trip mechanism 300 so that the rims 3120 and 3130 pass under the pin 611. Once the pin 611 is released from the hook 310, the spring 330 pushes against said pin via the slide 340, thereby causing the link 600 to pivot about the second pivot point P2, as shown in FIG. 16. Following the pivoting of the link 600, the guide 320 also pivots upwards about the pin 311.

Figure 17:
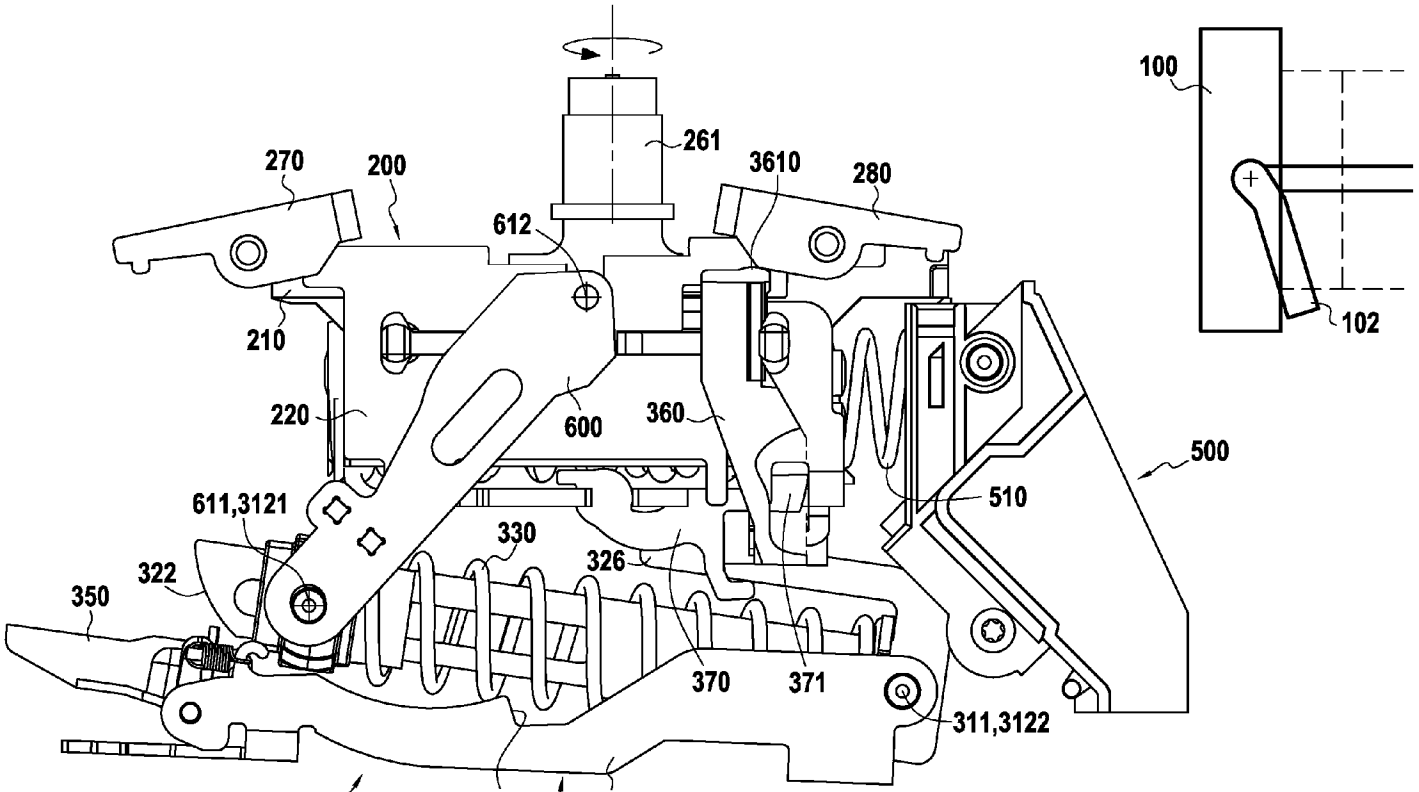
FIG. 17 is a diagrammatic side view showing some of the component elements of the trippable control system of FIGS. 1A to 3A when it is in a tripped breaking position.
Figure 21:
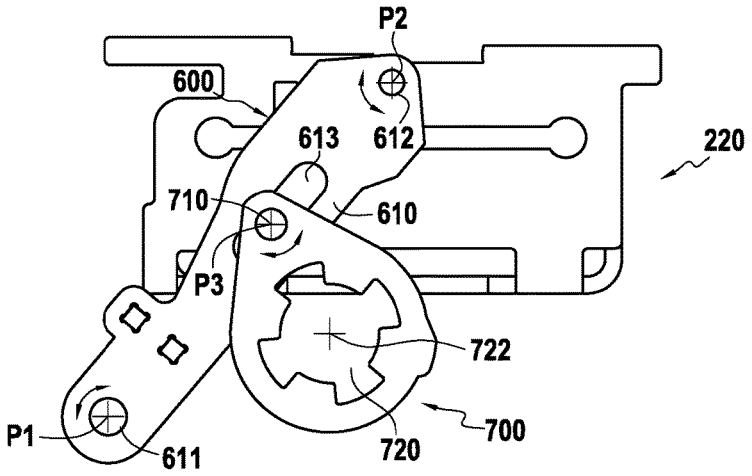
FIG. 21 is a simplified diagrammatic view showing the positions of the first and second links when the trippable control system is in a tripped breaking position.

At the end of the tripping operation, i.e. once the trip control system 100 is in its "tripped" position, the link 600 is in the position shown in FIGS. 17, 19, and 21. Pivoting of the link 600 about the second pivot point P2 serves to cause the link 700 to pivot about the center 722 of the opening 720 by the peg 710 sliding in the oblong slot 613, the link 700 thus causing the shaft 101 secured to the blade 11 of each breaker pole in such a manner as to place each breaker pole that is connected to the trippable control system into the open position as shown in FIG. 1B.

In this way, the trippable control system of the invention is capable at any instant of causing the breaker poles to open, and of doing so in a manner that is reliable since full tripping, i.e. sufficient pivoting of the link 700 to enable the breaker pole(s) connected thereto to open, is ensured under all conditions of use of the trippable control system, such as for example while a retaining force is being applied to the control handle.

The use of motion-reversing links in the trippable control system of the invention makes it possible in particular to avoid:

needing to combat the forces from the spring(s) of the manual opening/closing mechanism (in this example the spring 230) when opening of the breaker pole(s) is tripped automatically;

needing to declutch the manual control via the control handle; and needing to declutch the rear of the spring(s) of the manual mechanism.

The use of one spring that is dedicated to manual opening/closing of the breaker poles and of another spring that is dedicated to automatically tripping opening of the breaker poles makes it possible to ensure high speed and drive force on the members of breaker gear both during manual opening/closing and also when opening of the breaker poles is tripped automatically.

In a particular aspect of the trippable control system, the spring 230 of the accumulator mechanism and the spring 330 of the trip mechanism are dimensioned so as to generate the same torque curve, and consequently so as to generate similar speeds for manual opening/closing and for opening the breaker poles during automatic tripping.

In a manner that is optional, but advantageous, the trippable control system of the invention may be provided with means enabling the control handle to be placed in a particular position when the trippable control system 100 is in the tripped position. For this purpose, and as shown in FIGS. 14A and 14B, a pusher 360 is mounted on an arm 326 of the guide 320. More precisely, the pusher 360 has two tabs 361 and 362 that are connected together. The pusher 360 presses against the arm 326 of the guide 320 via a connection part 363 that serves to drive the tabs 361 and 362 towards the pawl 280 (FIG. 15). As shown in FIG. 16, at the beginning of the operation of automatically tripping opening of the breaker poles, the pivoting of the guide 320 causes the pusher 360 to move upwards. The respective ends 3610 and 3620 of the tabs 361 and 362 then come into contact with the pawl 280, pushing it upwards so as to release the outer carriage 220.

Figure 3A:
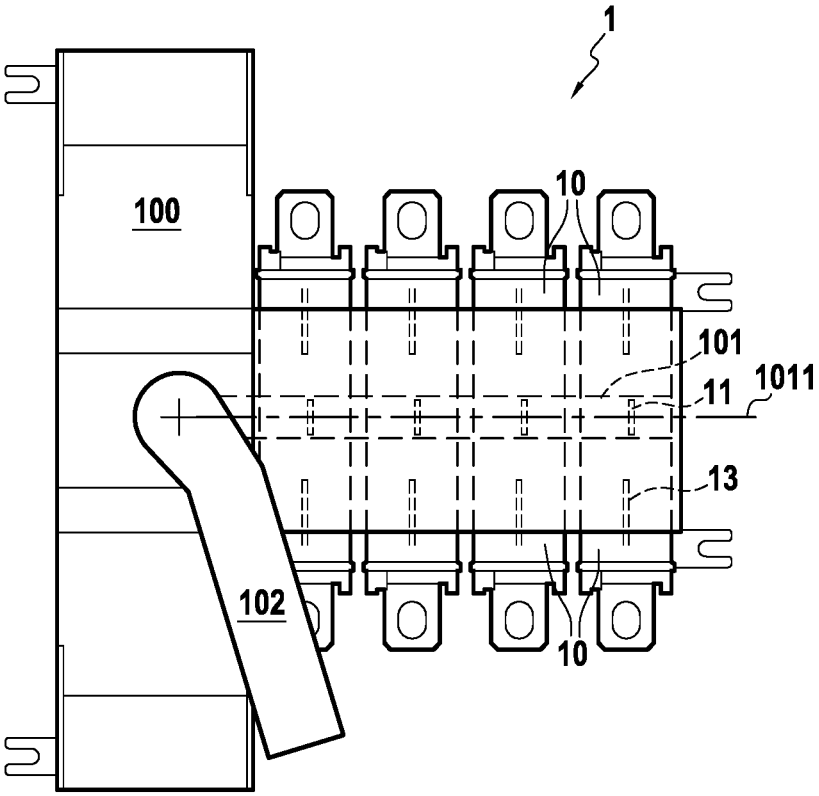
FIG. 3A is a diagrammatic view showing a trippable control system in a tripped and uncoupled position in accordance with an embodiment of the invention.
Figure 3B:
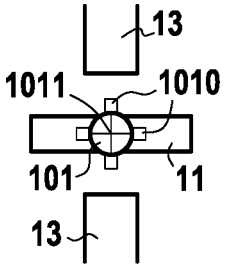
FIG. 3B shows a movable contactor in the tripped breaking position of the FIG. 3A system.

Under the effect of the spring 510, which is kept in compression while the system of the invention is placed in the position for manually closing the breaker poles, as shown in FIG. 12, the inner and outer carriages 210 and 220 move over a short distance (e.g. a few millimeters) towards the position for opening the breaker pole(s), thereby giving rise, as shown in FIGS. 3A and 17, to the control handle 102 moving into an intermediate position, referred to as the "uncoupled" position and situated between its open position (FIG. 1B) and its closed position (FIG. 2B). The tripped position of the trippable control system of the invention can thus be detected merely by observing that the control handle is in its uncoupled position.

As shown in FIGS. 14A and 14B, the trippable control system of the invention further includes a latch 370 fastened to the arm 326 of the guide 320. During automatic tripping of the opening of the breaker pole(s), the pivoting of the guide 320 causes the rear portion 371 of the latch 370 to rock upwards, as shown in FIGS. 16 and 17. At the end of the operation of automatically tripping opening of the breaker pole(s), the rear portion 371 locks the inner and outer carriages 210 and 220 together. It is thus possible to reset the system after the automatic tripping operation.

Figure 20:
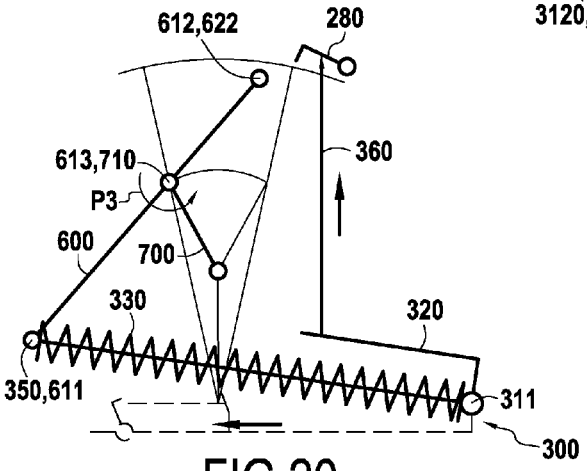

As shown in FIG. 20, by turning the control handle counterclockwise from its tripped position (FIG. 17), i.e. towards its open position (FIG. 1A), the movement of the outer carriage (not shown in FIG. 20) drives pivoting of the first link 600 about a third pivot point P3 corresponding to the peg 710 of the second link 700, which is engaged in the oblong slot 613 formed in the arm 610 of the first link 600. This action on the control handle enables the manual opening/closing mechanism of the breaker poles to be returned to its open position (FIGS. 1A, 1B, 8, and 10). It also makes it possible to reset the spring 330 of the second trip mechanism 300 (FIG. 23).

Figure 22:
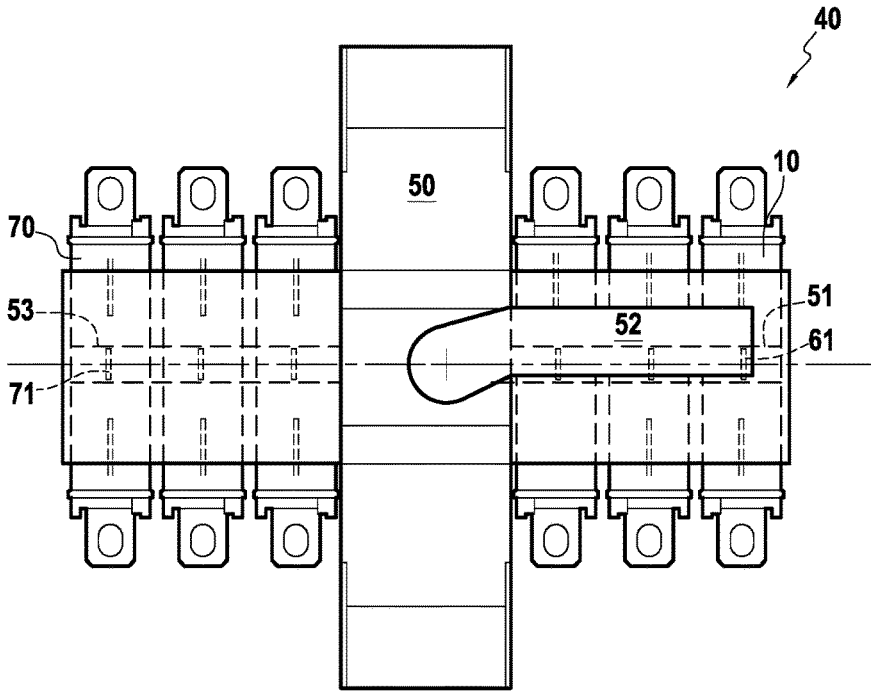
FIG. 22 is a diagrammatic view showing the trippable control system in a breaking position in accordance with another embodiment of the invention.

The above-described trippable control system may also be interposed between control poles. FIG. 22 shows breaker gear 40 including a trippable control system 50 identical to the system 100 described above. Breaker poles 60 are placed on one side of the system 50 while breaker poles 70 are placed on the other side of the system 100. In this embodiment, it is advantageous to use the above-described symmetrical architecture of the link 600, i.e. a link comprising two arms that are connected together. The movable members 63 of the breaker poles 60 are actuated by the first arm 610 of the link 600 via the link 700 (not shown in FIG. 22), and a breaker shaft 51 connected both to the link 700 (not shown in FIG. 22) and to the movable members 63. The movable members 73 of the breaker poles 70 are actuated by the second arm 620 of the link 600 via a link identical to the link 700 slidably connected with the arm 620 (not shown in FIG. 22) and a breaker shaft 53 connected both to said link (not shown in FIG. 22) and to the movable members 73. Thus, the breaker poles 60 and 70 are actuated by a single trippable control system.

In the light of FIGS. 18 to 20, the person skilled in the art will have no difficulty in devising other possible embodiments of the trippable system of the invention enabling breaking to be tripped automatically on the principle of the invention.

The invention claimed is:

1. A trippable control system for one or more electrical breaker poles, the system comprising:

an accumulator mechanism presenting a control handle movable between a breaker position and a closed position;

a first link pivotable about a first pivot point between a first position and a second position, and vice versa, by actuating the control handle of the accumulator mechanism between the breaker position and the closed position, and vice versa;

a second link pivotable about a pivot axis for connecting to one or more breaker poles, the second link including a peg in a position that is offset from the pivot axis, the peg being engaged in an oblong slot present in the first link so as to provide a sliding and hinged connection between the first and second links so that the movement of the first link between the first position and the second position, or conversely between the second position and the first position, causes the second link to pivot about the pivot axis between a position for opening the breaker pole(s) and a position for closing the breaker pole(s), or conversely between a position for closing the breaker pole(s) and a position for opening the breaker pole(s); and a trip mechanism suitable for releasing the first pivot point of first link and for exerting a movement force on the first link in the vicinity of said first pivot point so as to move the first link between the second position and a third position when said first link pivots about a second pivot point, the movement of the first link between the second position and the third position causing the second link to pivot about the pivot axis between the position for closing the breaker pole(s) and the position for opening the breaker pole.

2. A system according to claim 1, wherein the accumulator mechanism is suitable for releasing the second pivot point of the first link when the first pivot point of said first link is released by the trip mechanism so as to drive pivoting of the first link about a third pivot point corresponding to the sliding connection connecting the second link to said first link, the pivoting of the first link about the third pivot point causing the control handle to move into an intermediate position between the breaking position and the closed position of said handle.

3. A system according to claim 2, wherein the accumulator mechanism comprises an inner carriage connected to the control handle and an outer carriage connected to the first link, and wherein it comprises a bias spring suitable for moving the inner and outer carriages over a short distance when the accumulator mechanism releases the second pivot point of the first link in such a manner as to drive pivoting of the first link about the third pivot point and movement of the control handle into an intermediate position between the breaking position and the closed position of said handle.

4. A system according to claim 1, wherein the first accumulator mechanism comprises a first spring for exerting, when compressed, a force on the first link as it pivots about the first pivot point between the first position and the second position of said first link, and vice versa, and in that the second trip mechanism comprises a second spring suitable, when compressed, for exerting a force on the first link during its movement between the second position and the third position when said first link pivots about the second pivot point.

5. A system according to claim 4, wherein the first spring and the second spring are dimensioned so as to generate the same torque curve.

6. A system according to claim 1, wherein it comprises manual control means for releasing the first pivot point of the first link.

7. A system according to claim 1, wherein it comprises electromechanical control means for releasing the first pivot point of the first link.

8. A system according to claim 4, wherein the accumulator mechanism comprises an inner carriage connected to the control handle and an outer carriage connected to the first link, the inner carriage sliding in the outer carriage during the movement of the control handle between the breaking position and the closed position, the first spring being interposed between the inner carriage and the outer carriage, and wherein the trippable control system comprises a latch element suitable for locking the inner carriage with the outer carriage after the movement of the first link between the second position and the third position so as to enable the second spring of the trip mechanism to be reset without needing to compress the spring of the first mechanism.

9. Electrical breaker gear comprising one or more electrical breaker poles fitted with a movable contactor, wherein said gear further comprises a trippable control system according to claim 1, a breaker shaft connecting each movable contactor of the breaker pole(s) to the pivot axis of the second link.

* * * * *